US006094773A

United States Patent [19]

Krentz et al.

[11] Patent Number: 6,094,773

[45] Date of Patent: Aug. 1, 2000

[54] PORTABLE CLEANING DEVICE FOR A MOUNTAIN BIKE

[76] Inventors: Douglas R. Krentz, 2850 Carrollton Rd., Annapolis, Md. 21403; Scott Krentz, 5 Dell Ave., Netcong, N.J. 07857

[21] Appl. No.: 09/062,555

[22] Filed: Apr. 20, 1998

[51] Int. Cl.[7] ..... A47L 5/12

[52] U.S. Cl. ..... 15/321; 15/323; 15/344; 417/234

[58] Field of Search ..... 15/313, 321, 323, 15/339, 344; 417/234, 199.1; 239/304, 310, 154, 375, 289

[56] References Cited

U.S. PATENT DOCUMENTS

| | | | |
|---|---|---|---|
| 2,359,534 | 10/1944 | Slatnick | 222/399 |
| 2,772,922 | 12/1956 | Boyd et al. | 222/399 |
| 2,889,997 | 6/1959 | Gallo | 239/375 |
| 2,958,155 | 11/1960 | Emmerich | 222/130 |
| 3,380,658 | 4/1968 | Stasz et al. | 239/304 |
| 3,993,245 | 11/1976 | Smith | 239/8 |
| 4,135,669 | 1/1979 | Bridges et al. | 239/373 |
| 4,222,521 | 9/1980 | Nielsen | 239/135 |
| 4,787,560 | 11/1988 | Deyoreo | 239/373 |
| 4,790,454 | 12/1988 | Clark et al. | 239/304 |
| 4,830,579 | 5/1989 | Cheng | 417/234 |
| 4,972,975 | 11/1990 | Fuhrig | 222/182 |
| 5,104,295 | 4/1992 | Wong | 417/234 |
| 5,147,182 | 9/1992 | Timmons | 417/234 |
| 5,165,139 | 11/1992 | Oxman | 15/321 |
| 5,263,223 | 11/1993 | Fiegel et al. | 15/321 |
| 5,526,957 | 6/1996 | Brown et al. | 222/94 |
| 5,529,220 | 6/1996 | Credele, Jr. et al. | 222/175 |

*Primary Examiner*—Theresa T. Snider
*Attorney, Agent, or Firm*—Robert N. Blackmon

[57] ABSTRACT

A utility device useful for cleaning mountain bikes or other similar items which may get muddy or dirty at a location remote from the user's home. The cleaning device has a water pump which can selectively be connected through a needle valve to a chamber containing degreaser or soaps or similar material. An air compressor is also provided to supply compressed air for filling bike tires or spraying compressed air. A vacuum motor can be provided also to provide a vacuum function along with the sprayer portion of the device. An electrical outlet provided on the device can be used to power small dc utilities when the cleaning device is plugged into a car or similar vehicle through the cigarette lighter adapter. An override switch prevents the electrical outlet from powering devices while the air compressor or pump is being used. A utility case made of neoprene or similar material provides pockets for tools or hoses for use with the other devices.

18 Claims, 5 Drawing Sheets

PORTABLE CLEANING DEVICE FOR A MOUNTAIN BIKE

BACKGROUND OF THE INVENTION

1. Field of the Invention

The present invention relates to a portable, powered cleaning unit for cleaning a mountain bike at a remote location, comprising a housing unit housing a fluid chamber, a cleaning fluid chamber, a pump, an air compressor and an energy supply or storage means, wherein the energy supply means can selectively operate the pump to pump the fluid from the fluid chamber or pump a combination of fluid combined with cleaning fluid from the cleaning fluid chamber or can supply energy to the air compressor to inflate tires or provide a flow of compressed air for cleaning.

2. Description of the Prior Art

When we look at the past decade, we see that people have been busier than ever. They are busier in almost every facet of their lives; they are hard at work and are hard at play. The well-defined work week has led to a well defined recreation time, and people are taking advantage now of their limited time off to engage in recreational activities more now than at any point in the last decade.

Among recreational activities gaining in popularity, biking, camping, and traveling top the list of a host of other activities which are all done outside the home. The vastly growing sales of products related to these activities evidence the increased participation in these diversions. Perhaps the largest growth industry in the last decade among recreational activities and in their related sports equipment sales has been the introduction and explosion in popularity of the mountain bike. Its rapid growth has taken the mountain bike from relative obscurity to commonplace to nearly causing the extinction of the 10-speed bicycle.

Unfortunately for mountain bicycling enthusiasts living in urban areas, the best areas for biking are often located far from their residences. So the enthusiast is left to transport his bicycle on top of a rack on his car or in the back of his wagon or sport utility vehicle to a location where the buildings and sidewalks are replaced by trees and hills. After a day of hard mountain biking down single-tracks and through the mud, the mud-packed mountain bike has to be thrown back into the car or mounted on to the bike rack throwing dirt and mud all over the car and the cyclist. Once back at home the cyclist can finally clean the mud and dirt off the bicycle which has dried and hardened during the trip home. The time consuming effort is compounded by the added effort of having to clean the car inside and out after cleaning the bicycle, reducing the amount of time spent enjoying bicycling and increasing the effort involved.

For those cyclists living in apartment buildings or areas where water spigots are not readily available, the burden of the task is greatly enhanced as he is forced to carry buckets of water down the elevator or stairs and out into the parking lot to clean the bicycle. And as everyone who has cleaned a vehicle outside using the bucket method can remember, the actually cleaning power of the water in the bucket decreases with each dip of the sponge as more and more mud is deposited back into the bucket from the sponge or cleaning rag and is mixed with the cleaning water. As the process continues, mud and dirt are actually put back on the bike from the muddied clean water bucket unless the user diligently carries out fresh buckets of water.

The present invention is drawn to a novel method of providing a unit for cleaning a bicycle at a location remote from spigots or free sources of water. The portable cleaning unit has a water storage area and a cleaning solution storage area which can be combined and sprayed directly on to a mountain bike to clean the bike before securing the bike on or within a car or truck. A pressurizing water pump is run by an electrical source preferably a dc current provided by the cigarette lighter of a vehicle. The pump draws water and selectively cleaning fluid together and sprays the fluid onto the bicycle using a hose or wand attached to the pump. Selective controls on the unit can also be used to power an air compressor for use in filling bicycle tires in conjunction with a provided air filler hose or can power a motor for a vacuum unit. A built in pressure gauge can be used to gauge the pressure of the air filling the tires to prevent a blowout. A panel on an end of the unit allows access to the chamber enclosing the working parts of the device including the pump, air compressor and vacuum motor. An optional neoprene casing can be fitted over the whole unit and may include pockets to hose tools or parts for the unit.

By bringing the portable cleaning device to the remote riding location, the user is able to clean the bike before loading the bike on or into the car. In addition, on particularly muddy days, the rider can clean the bike between legs of the ride so that the bike is not slowed by the immense amounts of mud caked on the bicycle.

The concept of a pump attached to a container is not new.

U.S. Pat. No. 2,359,534 to Slatnick shows a foot-operated pump attached to a water container for extinguishing fires and incendiary bombs.

U.S. Pat. No. 2,772,922 to Boyd et al. shows a pressurizable container for a liquid. A pump attached to an air inlet forces air into the container to pressurize the liquid so that the liquid may be expelled under the force of the air provided by the air pump.

U.S. Pat. No. 2,958,155 to Emmerich shows a gasoline engine powered blower attached to a container of insecticide for spraying the insecticide which can either be in liquid or powder form.

U.S. Pat. No. 3,993,245 to Smith shows a hand pump for pressurizing a tank to force a pesticide in the tank through a spray valve onto a desired area.

U.S. Pat. No. 4,135,669 to Bridges et al. shows a wheeled, pressurized tank which is attached to a motorized compressor for pressurizing the tank. A valved hose attached to the hose selectively sprays fluid from the tank onto a predetermined area.

U.S. Pat. No. 4,222,521 shows a pressure tank for cleaning objects. Air forced into the tank by a pump forces the fluid out when a valve on a spray gun is released. Cleaning fluid may be optionally added directly to the fluid in the tank.

U.S. Pat. No. 4,787,560 to DeYoreo shows a portable, manually pressurizable liquid sprayer having a wand for directing the spray.

U.S. Pat. No. 4,972,975 to Fuhrig shows a battery operated spray can for spraying liquids. A compressor operated by the battery pumps air into the liquid chamber to pressurize the container and the liquid therein.

U.S. Pat. No. 5,526,957 to Brown et al. shows a chemical dispensing unit which is operated by pressurizing flexible containers surrounding the chemical reservoirs to force the chemicals out through a valved nozzle.

U.S. Pat. No. 5,529,220 to Credle, Jr. et al. shows a backpack-mounted beverage dispenser having an insulating pack surrounding a number of two litre bottles filled with premixed liquids. A $CO_2$ cylinder provides pressurization to force the fluids out through a dispensing nozzle.

None of the above inventions and patents, taken either singly or in combination, is seen to describe the instant invention as claimed.

SUMMARY OF THE INVENTION

Accordingly, it is a principal object of the invention to provide a portable cleaning device for cleaning a bicycle.

It is another object of the invention to provide a portable cleaning device which has a liquid pressurizing pump for spraying water or other fluids onto a bicycle to clean mud and debris off the bicycle.

It is a further object of the invention to provide a portable cleaning device which has a chamber for water and a chamber for cleaning fluid and a mixing valve for spraying water mixed with cleaning fluid.

Still another object of the invention is to provide a portable, cleaning device which has a pressurizing pump that can be operated using a self-contained battery or run off the battery of a motor vehicle.

It is another object of the invention to provide a portable, cleaning device which has an air-compressor and hose for filling the tires of bicycles or blowing compressed air.

It is another object of the invention to provide a vacuum source in a portable cleaning device for cleaning a bicycle by suction.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT(S)

Figure 1:
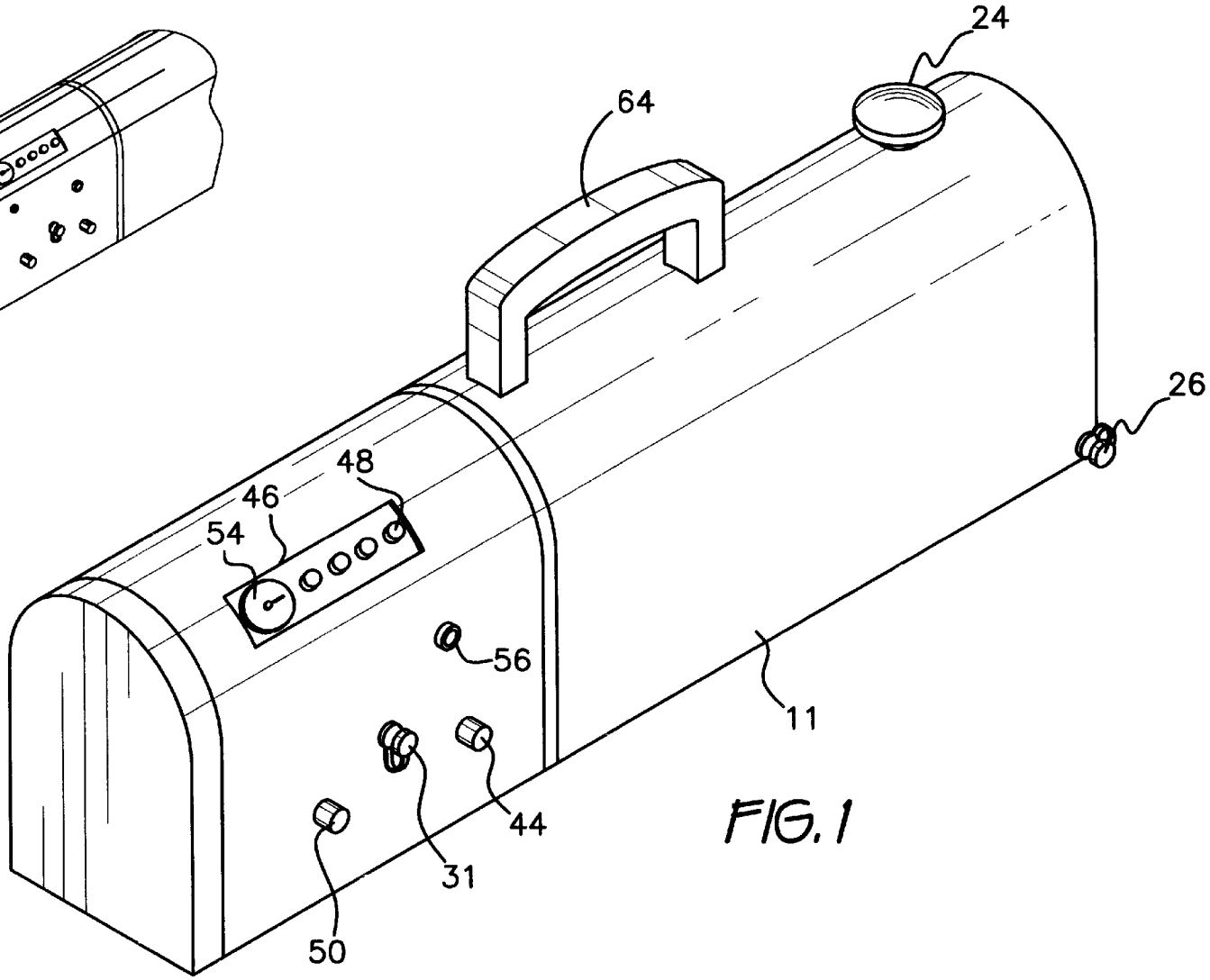
FIG. 1 is an environmental perspective view of the outer housing and switches of the portable cleaning device according to this invention.
Figure 2:
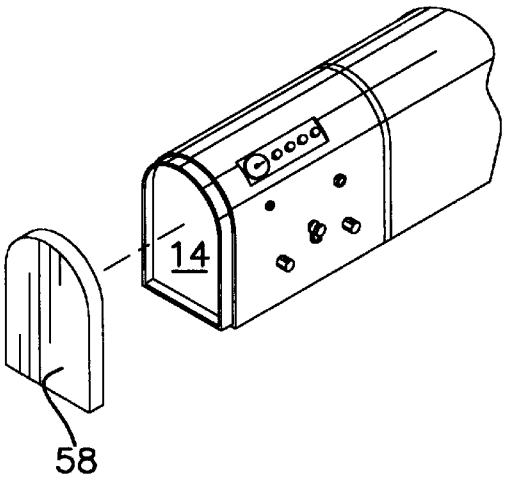
FIG. 2 is an environmental perspective view of the outer housing of the portable cleaning device with the removable side panel separated from the housing.
Figure 3:
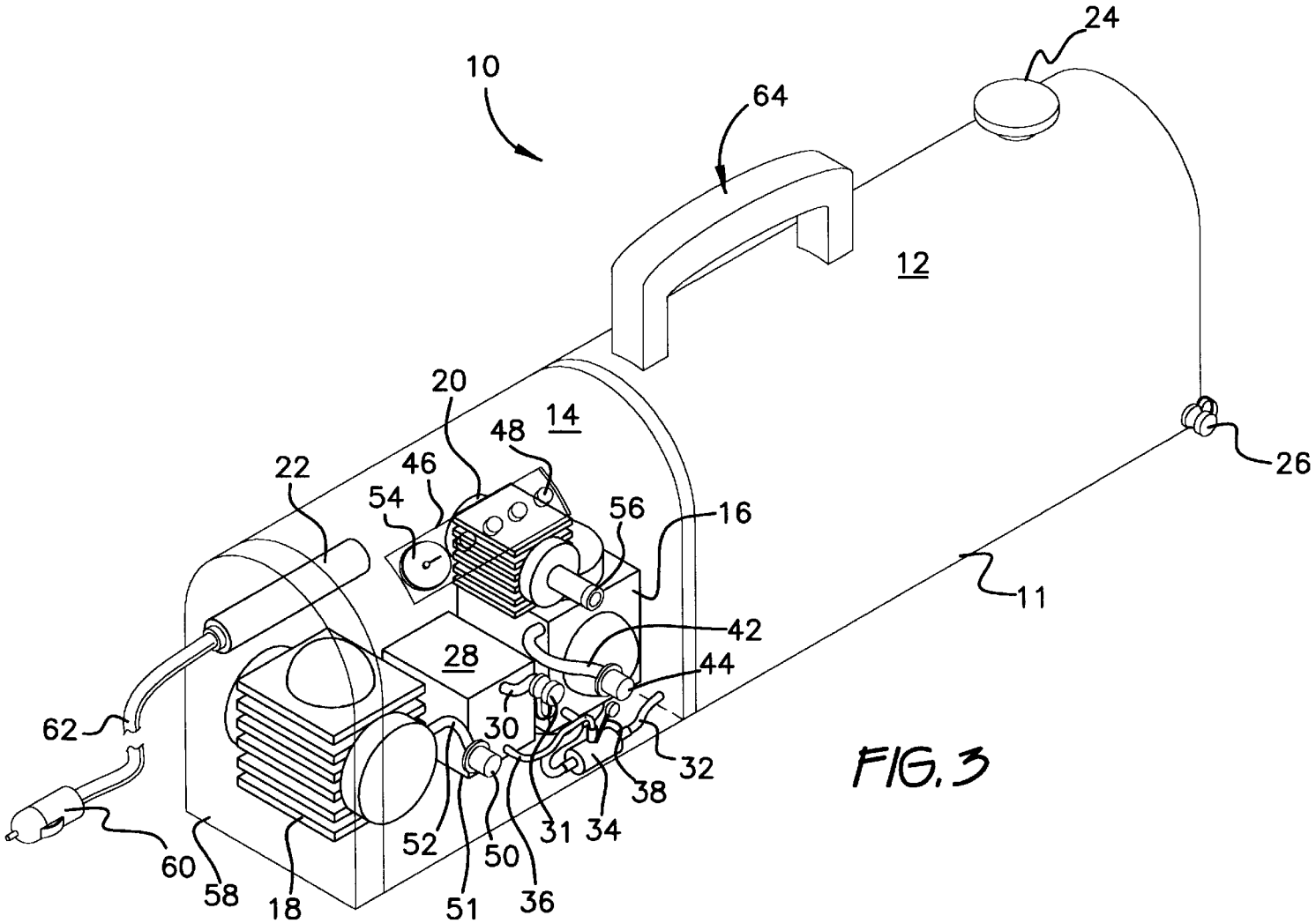
FIG. 3 is an environmental perspective view of the internal components of the portable cleaning device with the outer housing shown in ghost lines to show the arrangement of the internal components.

The present invention is a portable, powered cleaning device for cleaning a mountain bike at a remote location. The cleaning device 10 has a number of housing walls 11 which house a fluid chamber 12 containing water or other fluids for spraying on a bicycle, and a utility chamber 14 housing a liquid or fluid pump 16, an air compressor 18, a vacuum pump 20, and an electrical storage and supply device 22.

The fluid chamber has a fill cap 24 on a top wall of the housing 11 for adding water or other fluids to the chamber. The fluid chamber also has a drain plug 26 located proximate the bottom of the chamber to drain out the water and any sediment out of the chamber in a known fashion.

A second chamber 28 is provided within the housing 11 to store soap, degreasing agents, or other cleaners or fluids. The chamber 28 has an inlet 30 accessible from the exterior of the pump at connector 31 for filling the second chamber 28 with fluids. Appropriate valving or flow constrictors (not shown) are provided to prevent the soap from spilling or leaking through the inlet to the exterior of the pump. The second chamber 28 may be provided with a drain plug 51 to drain fluid from the chamber.

The fluid pump 16 has an inlet line 32 in fluid communication with said fluid chamber 12 for drawing in fluid from the chamber into the pump by a vacuum force.

Connected along the inlet line 32 is a branched valve 34 having a second inlet line 36 and a selector switch 38. The inlet line 36 has a smaller diameter line which can be selectively brought into or out of connection with the larger inlet line 32 by controlling the valve 34. The valve may be a needle valve or any type of restrictive valve which can restrict the flow area between the inlet line 32 and the inlet line 36. In a known manner, the amount of flow from the inlet line 36 into inlet 32 is controlled by a venturi effect by restricting the orifice on the valve 34. By moving the selector 38 and restricting the orifice (not shown) between inlet line 36 and inlet line 32, the flow rate of fluid drawn from inlet line 36 into inlet line 32 is reduced until the orifice is completely blocked by the valve and no fluid can flow from inlet line 36 into inlet line 32. In this fashion the relative proportion of water from fluid chamber 12 and soap or cleaner from the second chamber can be controlled to pump either entirely water from the pump or a water and cleaner mixture.

Located at the outlet of the pump is an outlet line 42 which leads to an outlet connector 44. The connector may be of the quick-connect kind such that a hose or or wand or other outlet flow control device may be connected to the pump outlet line to carry the pumped fluid to a remote location. The outlet control device may be a wand or other device with a releasable valve to turn on and shut off flow from the pump. Also the outlet flow control device may have a number of attachments which are particularly useful in cleaning a bicycle, such as a sprayer having a brush at the end of the hose or other such device.

A control panel 46 mounted to an exterior wall 11 of the cleaning device controls the operation of the fluid pump 16. A number of selector buttons 48 or similar devices are mounted to the control panel 46. By pressing a selector button 48 associate with the fluid pump 16, electrical energy is connected from the energy supply device 22 to the fluid pump 16 thus energizing the fluid pump in a well known manner and causing the fluid pump 16 to draw fluid from one or both of the fluid chambers. The fluid pump 16 may also have an automatic start/stop switch that is operated by fluid pressure sensors or other equivalent devices while the selector switch provides energy to the fluid pump. After energy is supplied to the fluid pump from the energy supply device 22, a fluid pressure sensor (not shown) can be used to turn on the pump when the pressure at the outlet of the pump is below a certain pressure, especially when the fluid is being used during cleaning or in preparation of cleaning. The fluid pressure sensor can also shut off the fluid pump when the cleaning device is not in use or after sufficient demand pressure is built up in the pump in anticipation of cleaning. This automatic start/stop switch reduces the energy load required by the pump and helps protect the pump and pump lines from reaching an overpressure situation.

An air compressor 18 is also provided within the utility compartment 14. The air compressor is energized in a similar manner to the fluid pump 16 by energizing an appropriate switch 48 on the control panel 46. The air compressor 18 provides pressurized air to an outlet connector 50 through the air compressor outlet line 52.

The fluid control outlet device hose or a different outlet hose or control device can easily be connected to the outlet connector 50 which is also preferably of the quick-connect type. The opposite end of the outlet hose can preferably receive various adapters such as a spray wand for spraying compressed air on the bicycle for cleaning or to an air chuck for inflating bicycle tires and similar tasks. The air outlet line may also contain a pressure sensor (not shown) for turning on and shutting off power to the air compressor in a similar manner discussed for the fluid pump. The outlet pressure sensor can be use in combination with an air pressure gauge 54 to read out the outlet pressure as a visual check device to prevent overfilling of the bicycle tire or similar device to be inflated when the outlet connector is connected to an air chuck.

A vacuum motor 20 is also preferably contained within the utility chamber 14. The vacuum is controlled by depressing the appropriate switch 48 on the control panel 46 to energize the vacuum motor. The vacuum pump 20 is connected to an outlet connector 56 of the quick-connect type. To the quick-connect connector, a vacuum hose (not shown) may be connected and standard vacuum hose attachments may be connected to the opposite end of the vacuum hose for vacuuming dirt off of the bicycle. The attachments may also be specifically shaped for use with a bicycle as the case may be. While the vacuum hose may be the same as the hose attached for the fluid pump and for the air compressor, it is envisioned that the vacuum hose will need to be of a much larger diameter to accommodate the dirt and other items vacuumed from the bicycle which must be carried back down the vacuum hose to the vacuum filter (not shown) within a chamber of the motor 18 as is well known in the art.

The energy supply 22 can be a dc battery which is either rechargeable or replaceable or a transformer receiving external current. The energy storage and supply 22 is preferably connected to a cigarette lighter adapter 60 at the end of a length of electrical cord 62 for plugging the cleaning device 10 into the cigarette lighter (not shown) of a vehicle (not shown). The current drawable from a vehicle battery through the lighter adapter should be more than sufficient to run any of the cleaning devices within the utility chamber of the cleaning device. An end panel 58 on one end of the housing is removable to expose the utility chamber. The chamber may also have an area for storing the electrical cable 62 and adapter 60. A further adapter may also be provided for plugging the device into alternative energy sources such as a standard wall outlet of a residence.

Figures 4, 5:
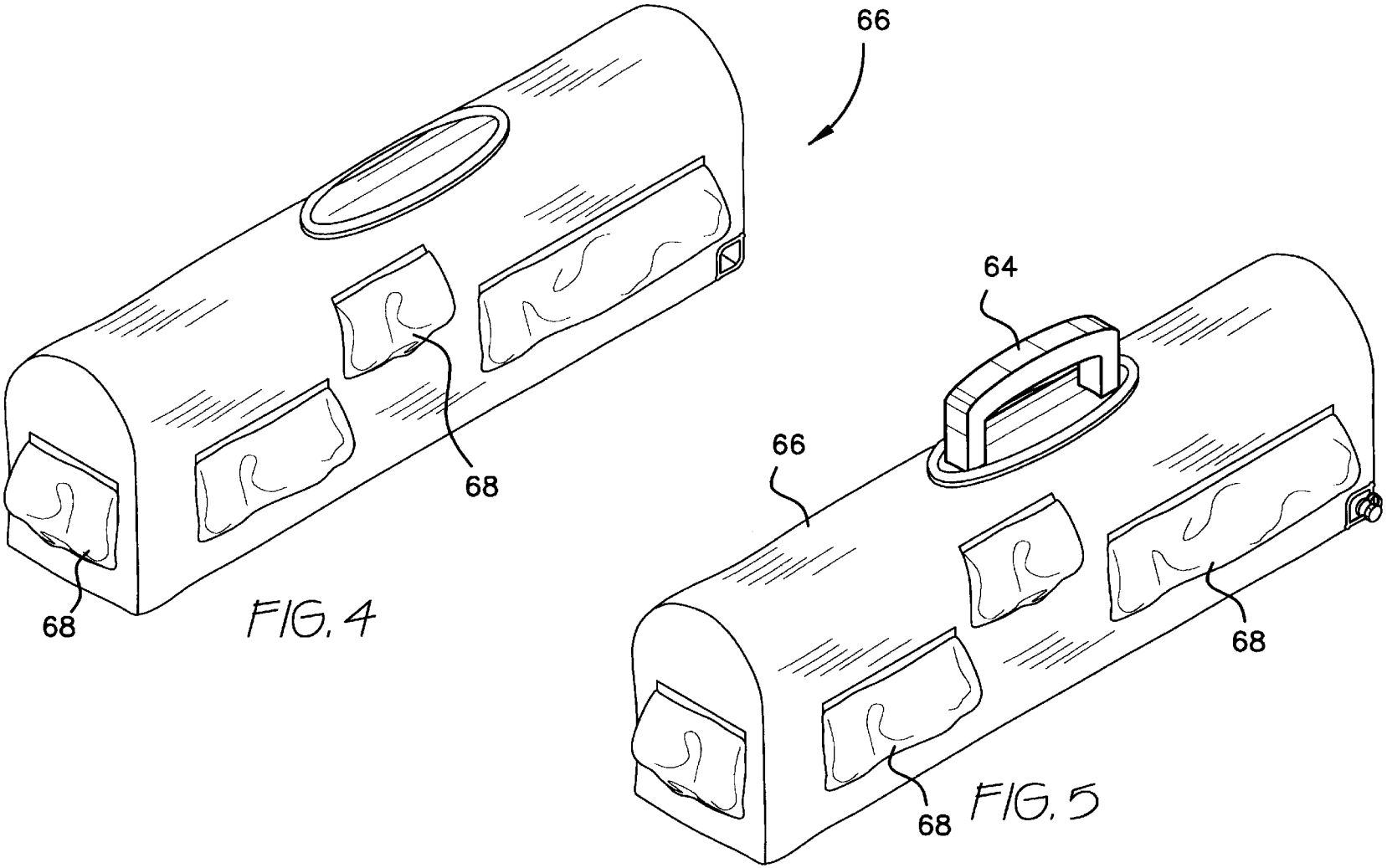
FIG. 4 is an environmental perspective view of an optional cover for the portable cleaning device.
FIG. 5 is an environmental perspective view of the optional cover for the portable cleaning device shown installed on the portable cleaning device.
Figure 6:
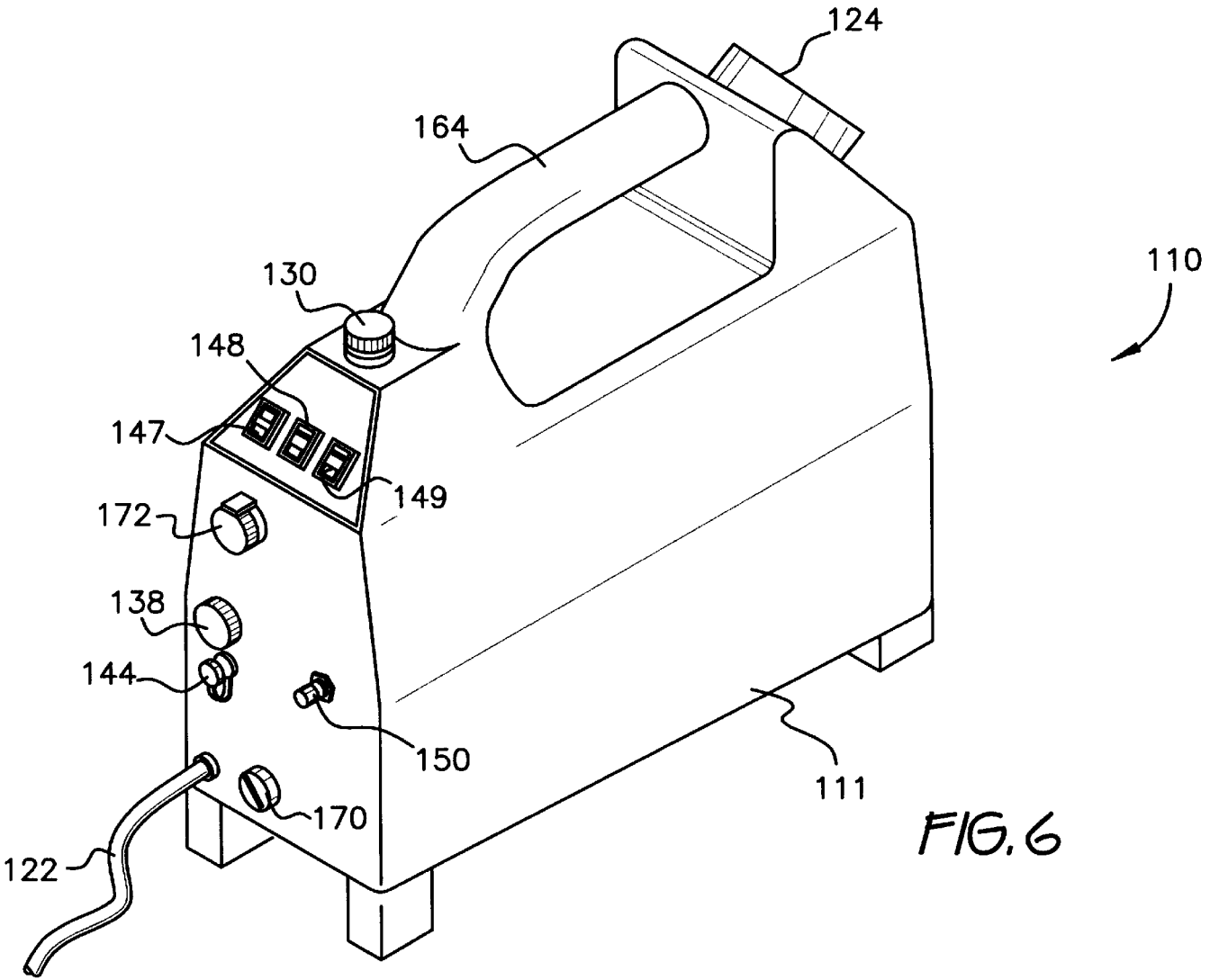
FIG. 6 is an environmental perspective view of the outer housing and switches of the portable cleaning device according to a second embodiment of the invention.

In order to make the operation of the cleaning device 10 more convenient, two additional features of the cleaning device have been incorporated into the preferred design. A handle 64 is provided on a top surface of the housing 11 to increase the portability of the device. In addition, a utility case 66 made of neoprene or similar rugged material has been provided which can be installed over the cleaning device 10. The utility case 66 as best shown in FIGS. 5 & 6 has a number of pockets 68 for storing implements. The storage pockets 68 may be sized to accept the outlet flow control hoses, hose attachments, air chucks, or general bicycle tools or fluid soap containers, etc., for easy storage of tools relating to the service or cleaning of the bicycle. The case may further include a zipper or hook and loop fasteners on the case or storage pockets for easy closure thereof.

Figure 7:
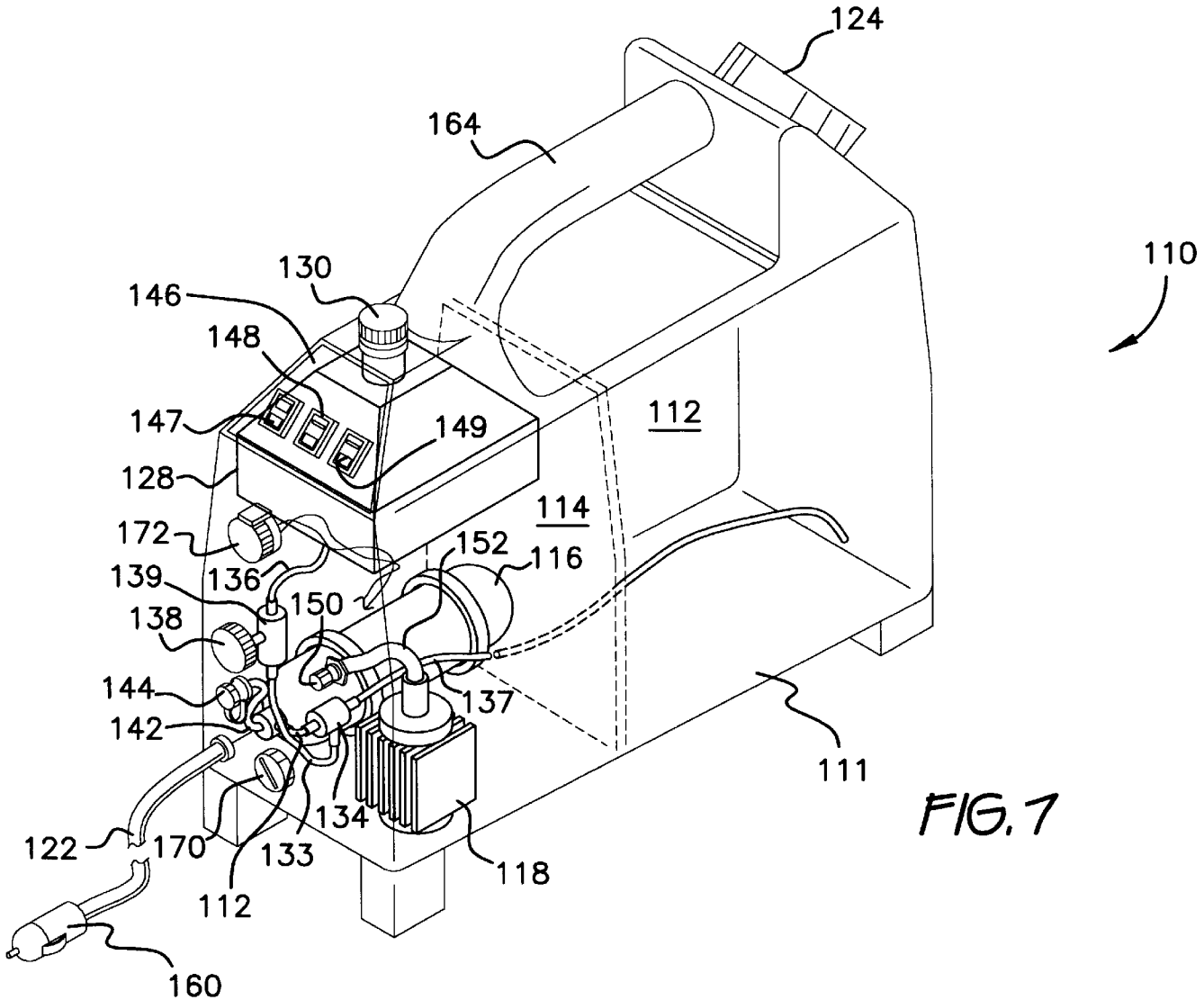
FIG. 7 is an environmental perspective view of the internal components of the second embodiment of portable cleaning device with the outer housing shown in ghost lines to show the arrangement of the internal components.

A second embodiment of the invention showing a stand-up body style and varied arrangement is shown in FIGS. 6–7. Where possible, elements which are common to the first embodiment are shown with the same first two digits of the reference numeral (e.g., 32 & 132).

The cleaning device 110 according to the second embodiment has a number of housing walls 111 which house a fluid chamber 112 containing water or other fluids for spraying on a bicycle, and a utility chamber 114 housing a fluid pump 116, an air compressor 118, and an electrical storage and supply device 122. The device may also have a vacuum motor as shown in the first embodiment, but is shown here electively without such a vacuum motor.

The fluid chamber has a fill cap 124 on a top wall of the housing 11 for adding water or other fluids to the chamber. A second chamber 128 is provided within the housing 111 to store soap, degreasing agents, or other cleaners or fluids. The chamber 128 has an inlet cap 130 accessible from the top exterior of the housing for filling the second chamber 128 with fluids.

The fluid pump 116 has an inlet line 132 in fluid communication with said fluid chamber 112 for drawing in fluid from the chamber into the pump by a vacuum force. Connected along the inlet line 132 is a branched valve 134 having a second inlet line 137. Preferably this branch valve has a main axis containing the fluid chamber inlet line at one end and an outlet line 133 connected at a second end.

The inlet line is connected at an acute angle to inlet line 132. Fluid friction of the flow through the branch valve from the inlet 132 through the branch valve and the outlet line 133 create a vacuum in inlet line 137 through the well known venturi effect and acts to draw fluid into the branch valve from the secondary inlet line 137. The cleaning fluid drawn into the branch valve in this manner is mixed with the water from the main fluid chamber and is provided to an inlet of the fluid pump 116 through the fluid pump inlet line 133.

In this embodiment a needle valve 139 is provided between the second fluid chamber 128 and the branch valve 134. An outlet line 136 from the second fluid chamber carries fluid to the need valve 139. By turning the needle valve control knob 138, the amount of fluid available in line 133 and thus the amount of fluid to the branch valve can be controlled to select the mixture of water and cleaning fluid sprayed by the device. Turning the control knob 138 to its stop in the clockwise direction will prevent any cleaning fluid from mixing with the water, and only water will be supplied to the fluid pump inlet line 133. Turning the control knob to its stop in the counterclockwise direction will reduce the restriction of the needle valve and allow the maximum amount of cleaning fluid to be mixed with the water.

Located at the outlet of the pump is an outlet line 142 which leads to an outlet connector 144. The connector may be of the quick-connect kind such that a hose or or wand or other outlet flow control device may be connected to the pump outlet line to carry the pumped fluid to a remote location. The outlet control device may be a wand or other device with a releasable valve to turn on and shut off flow from the pump. Also the outlet flow control device may have a number of attachments which are particularly useful in cleaning a bicycle, such as a sprayer having a brush at the end of the hose or other such device.

A control panel 146 mounted to an exterior wall 111 of the cleaning device controls the operation of the fluid pump 116. A number of selector buttons 147, 148, 149 or similar devices are mounted to the control panel 46. By pressing a selector button 147 associated with the fluid pump 116, electrical energy is connected from the energy supply device 122 to the fluid pump 116 thus energizing the fluid pump in a well known manner and causing the fluid pump 116 to draw fluid from one or both of the fluid chambers. The fluid pump 116 may also have an automatic start/stop switch and associated fluid pressure sensor as described above with reference to the first embodiment.

An air compressor 118 is also provided within the utility compartment 114. The air compressor is energized in a similar manner to the fluid pump 116 by energizing an appropriate switch 148 on the control panel 146. The air compressor 118 provides pressurized air to an outlet connector 150 through the air compressor outlet line 152. The fluid control outlet device hose or a different outlet hose or control device can easily be connected to the outlet connector 150 which is also preferably of the quick-connect type. In this embodiment, however, the outlet connector 150 for the air compressor is preferably of the female type, while the outlet of the fluid pump 131 is of the male type so that the user have to use a separate hose for the compressed air and for the cleaning fluid. The different hoses will act as a second confirmation of whether air or water is going to be pumped by the system. The opposite end of the outlet hoses can preferably receive various adapters as discussed above with reference to the first embodiment.

The energy supply 122 can be a dc battery with is either rechargeable or replaceable or a transformer receiving external current. The energy storage and supply 122 is preferably connected to a cigarette lighter adapter 160 as discussed above with reference to the first embodiment. A fuse access door 170 may be provided to allow access to a fuse (not shown) which may be connected in line with the power supply 122 in case fluids leak into chamber 114 and cause a short circuiting of the power circuit. A power outlet can also be provided. A female power outlet and cover 172 can provide a dc current to other dc powered items. A switch 149 controls power from the power supply 122 to the outlet 172. As a safety feature, when the switch 149 is in the "on" position supplying power to the power outlet 172, the switch may override switches 148 and 147 to prevent power from being delivered to the other electrical components while switch 149 is in the "on" position to prevent an electrical overload condition. A simple mechanical device on the switches could alternatively be used to ensure that switch 149 cannot be turned on while either switch 147 or 148 is in the "on" position.

The device according to the second embodiment of the invention may also further have a utility case (not shown) similar to the case shown in FIGS. 4–5 and configured to match the shape of the housing walls 111 and fit over the handle 164 and contain pockets as discussed above for the same reasons.

It is to be understood that the present invention is not limited to the sole embodiment described above, but encompasses any and all embodiments within the scope of the following claims.

We claim:

1. A cleaning device for supplying fluids, comprising:

a plurality of walls defining a first fluid chamber for containing a predetermined amount of liquid therein, said walls further defining a utility chamber housing an air compressor and housing a pump in fluid communication with said first fluid chamber for pumping said liquid, at least one control switch for selectively operating said pump to pump fluid from said first fluid chamber to a pump outlet to provide pressurized liquid to said pump outlet and for selectively operating an air compressor to provide compressed air to an air compressor outlet;

a second fluid chamber for containing a cleaning fluid, wherein said second fluid chamber is selectively in fluid communication with said pump for selectively pumping fluid from said second fluid chamber to said pump outlet.

2. The cleaning device according to claim 1, further comprising valving means for selectively allowing fluid from said second fluid chamber to be in fluid communication with said pump.

3. The cleaning device according to claim 2, wherein said pump has a pump inlet line in fluid communication with a branch valve connected intermediate said pump and said first fluid chamber and intermediate said pump and said second fluid chamber for selectively drawing fluid from said second fluid chamber into said pump;

said branch valve further having a flow constrictor for controlling flow from said second fluid chamber into said branch valve;

whereby controlling said flow constrictor on said second inlet line selectively allows fluid from said second fluid chamber to enter said pump inlet line and mix with liquid from said first fluid chamber.

4. The cleaning device according to claim 3, wherein the flow constrictor is a needle valve.

5. The cleaning device according to claim 3, wherein the pump outlet is a male connector and further comprising at least one hose having a female connector for selectively mating with said male connector of said pump outlet for conveying fluid from said pump outlet through said at least one hose to a location remote from said cleaning device.

6. The cleaning device according to claim 3, wherein the air compressor outlet is a female connector and further comprising at least one hose having a male connector for selectively mating with said female connector of said air compressor outlet for conveying fluid from said air compressor outlet through said at least one hose to a location remote from said cleaning device.

7. The cleaning device according to claim 1, further comprising:

a power supply source, a power outlet, and a second control switch for selectively communicating said power supply source with said power outlet to allow electrical devices external to said cleaning device to be connected to said powering outlet for power the electrical devices.

8. The cleaning device according to claim 7, wherein said power outlet supplies an direct voltage of approximately 12V.

9. The cleaning device according to claim 7, wherein further:

said second control switch has an power overload safety means which prevents operation of the pump and the air compressor when said power supply source is in communication with said power outlet.

10. The cleaning device according to claim 7, wherein said power supply source is a cigarette lighter adapter adapted to be received within the cigarette lighter of a vehicle.

11. The cleaning device according to claim 7, wherein said power supply source is a battery.

12. The cleaning device according to claim 7, further comprising:

a vacuum motor received within said utility chamber;

a vacuum line inlet in communication with said vacuum motor and a vacuum hose adapted to be selectively received by said vacuum line inlet for applying a vacuum suction to a location remote from said cleaning device.

13. The cleaning device according to claim 1, further comprising:

a utility case enclosing at least part of said plurality of walls.

14. The cleaning device according to claim 13, wherein said utility case further comprises means attached to said utility case defining storage pockets for storing at least one fluid hose.

15. The cleaning device according to claim 13, wherein said utility case is fabricated from neoprene.

16. A cleaning device for supplying fluids, comprising:

a plurality of walls defining a first fluid chamber for containing a predetermined amount of liquid therein, said walls further defining a utility chamber housing an air compressor and housing a pump in fluid communication with said first fluid chamber for pumping said liquid, at least one control switch for selectively operating said pump to pump fluid from said first fluid chamber to a pump outlet to provide pressurized liquid to said pump outlet and for selectively operating an air compressor to provide compressed air to an air compressor outlet;

a vacuum motor received within said utility chamber;

a vacuum line inlet in communication with said vacuum motor and a vacuum hose adapted to be selectively received by said vacuum line inlet for applying a vacuum suction to a location remote from said cleaning device.

17. The cleaning device according to claim 16, further comprising a second fluid chamber for containing a cleaning fluid, wherein said pump has a pump inlet line in fluid communication with a branch valve connected intermediate said pump and said first fluid chamber and intermediate said pump and said second fluid chamber for selectively drawing fluid from said second fluid chamber into said pump;

said second inlet line selectively allows fluid from said second fluid chamber to enter said pump inlet line and mix with liquid from said first fluid chamber.

18. A cleaning device for cleaning a bicycle comprising a housing having a plurality of exterior walls; a first and second fluid chamber for containing fluids and a utility compartment housed within said exterior walls, and a plurality of outlet connectors mounted to said exterior walls;

said utility compartment having a fluid pump, an air compressor, a vacuum pump, and an energy supply device contained therein;

said energy supply device having a control unit for selectively energizing said fluid pump, air compressor, and vacuum pump and wherein said energy supply device is connected to a cigarette lighter adapter for drawing energy from a vehicle battery;

said fluid pump having an inlet line and an outlet line;

said inlet line of said fluid pump in fluid communication with said first fluid chamber and having a first valve for selectively communicating said second fluid chamber with said fluid pump;

said outlet line of said fluid pump in fluid communication with one of said plurality of outlet connectors mounted to said exterior wall for pumping fluid in said first fluid chamber and selectively pumping fluid in said second fluid chamber through said one of said plurality of outlet connectors;

said first fluid chamber having a fill port and a drain plug for respectively filling and draining fluid from said first fluid chamber;

said second fluid chamber having a fill port and a drain plug for respectively filling and draining fluid from said second fluid chamber;

said air compressor having an outlet line in fluid connection between said air compressor and a second of said plurality of outlet connectors mounted to said exterior wall for pumping compressed air through said second of said plurality of outlet connectors;

said vacuum pump having an inlet line in fluid connection between said vacuum pump and a third of said plurality of outlet connectors mounted to said exterior wall for providing a vacuum suction at said third of said plurality of outlet connectors;

said cleaning device further having at least one fluid hose selectively attachable to at least one of said plurality of outlet connectors for providing fluid connection of one of said plurality of outlet connectors with a location remote from said cleaning device;

said cleaning device further having a utility case enclosing at least part of said plurality of exterior walls and having means attached to said utility case defining storage pockets on said housing for storing said at least one fluid hose;

wherein by selectively energizing said fluid pump, air compressor, and vacuum pump through said control panel, fluid, compressed air, or vacuum suction may be provided through said at least one fluid hose to spray fluid, pump compressed air, or suction may be applied to a bicycle to clean or maintain the bicycle.

* * * * *